US009441358B2

(12) United States Patent
Hartman et al.

(10) Patent No.: US 9,441,358 B2
(45) **Date of Patent: *Sep. 13, 2016**

(54) FOLDING SHED

(71) Applicant: ULTRAFOLD BUILDINGS, INC., Indianola, NE (US)

(72) Inventors: Morris L. Hartman, Hayes Center, NE (US); Carrol O. Hartman, Bowling Green, KY (US)

(73) Assignee: ULTRAFOLD BUILDINGS, INC., Indianola, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/319,217

(22) Filed: Jun. 30, 2014

(65) Prior Publication Data

US 2014/0311053 A1 Oct. 23, 2014

Related U.S. Application Data

(63) Continuation of application No. 11/776,982, filed on Jul. 12, 2007, now Pat. No. 8,763,315.

(51) Int. Cl.

| | |
|---|---|
| ***E04B 1/344*** | (2006.01) |
| ***E04B 1/343*** | (2006.01) |
| ***E04H 1/00*** | (2006.01) |

(52) U.S. Cl.

CPC ..... *E04B 1/34357* (2013.01); *E04B 1/344* (2013.01); *E04B 1/3445* (2013.01); *E04B 1/34336* (2013.01); *E04H 1/005* (2013.01)

(58) Field of Classification Search

CPC .. E04B 1/34384; E04B 1/344; E04B 1/3442; E04B 1/3445

USPC ..... 52/70, 71, 79.1, 79.5

See application file for complete search history.

(56) References Cited

U.S. PATENT DOCUMENTS

| | | | | |
|---|---|---|---|---|
| 2,177,202 | A * | 10/1939 | Berge | 403/73 |
| 3,139,958 | A * | 7/1964 | De Witt | 52/70 |
| 3,294,464 | A * | 12/1966 | Lew | 312/258 |
| 3,971,185 | A * | 7/1976 | Hendrich | 52/745.14 |

(Continued)

FOREIGN PATENT DOCUMENTS

| | | |
|---|---|---|
| CN | 201110019 | 9/2008 |

OTHER PUBLICATIONS

Author Unknown, "Folding Portable Toilet Model FPT 300 Advantages", Datasheet [online]. Porta-John Industries, Inc. [retrieved on Nov. 12, 2014]. Retrieved from the Internet: <URL: http://www.toilets.com/Pdffiles/Patented_Folding_Toilet.pdf>.

(Continued)

*Primary Examiner* — Elizabeth A Quast
(74) *Attorney, Agent, or Firm* — Dorsey & Whitney LLP

(57) ABSTRACT

A folding shed including a roof with a first roof section pivotally connected to a first sidewall and a second roof section pivotally connected to a second sidewall. The folding shed may further include foldable first and second end walls, each pivotally connected to the first and second sidewalls. The folding shed may be transformed from an operation to a storage configuration by outwardly pivoting the first and second roof sections until the exterior surface of each roof section approximately abuts the exterior surface of the sidewall to which it is connected and inwardly moving foldable end walls until the interior surfaces of the sidewalls approximately abut the interior surfaces of the end walls.

16 Claims, 13 Drawing Sheets

(56) References Cited

U.S. PATENT DOCUMENTS

| | | | | | |
|---|---|---|---|---|---|
| 3,977,119 | A | * | 8/1976 | Nelson | 446/478 |
| 3,983,665 | A | * | 10/1976 | Burton | 52/71 |
| 3,984,948 | A | * | 10/1976 | Bussard | 52/69 |
| 4,035,964 | A | * | 7/1977 | Robinson | 52/66 |
| 4,037,385 | A | * | 7/1977 | Wahlquist | 52/745.02 |
| 4,074,475 | A | * | 2/1978 | Wahlquist | 52/70 |
| 4,167,838 | A | * | 9/1979 | Metheny | 52/79.5 |
| 4,242,845 | A | * | 1/1981 | Osborne, Sr. | 52/69 |
| 4,545,171 | A | * | 10/1985 | Colvin | 52/79.5 |
| 4,603,518 | A | * | 8/1986 | Fennes | 52/66 |
| 4,633,626 | A | * | 1/1987 | Freeman et al. | 52/71 |
| 4,660,332 | A | | 4/1987 | Colvin | |
| 4,726,155 | A | * | 2/1988 | Nahmias | 52/71 |
| 4,741,133 | A | * | 5/1988 | Kutzner | 52/79.5 |
| 4,779,514 | A | * | 10/1988 | Prigmore et al. | 52/79.5 |
| 4,780,996 | A | * | 11/1988 | Julien, Jr. | 52/68 |
| 4,909,268 | A | * | 3/1990 | Maggio | 52/79.5 |
| 4,951,432 | A | * | 8/1990 | Wilkinson | 52/80.1 |
| 5,038,765 | A | * | 8/1991 | Young et al. | 602/16 |
| 5,094,059 | A | * | 3/1992 | Ganescu | 52/641 |
| 5,103,603 | A | * | 4/1992 | Verby et al. | 52/72 |
| 5,107,639 | A | * | 4/1992 | Morin et al. | 52/71 |
| 5,205,089 | A | * | 4/1993 | Cunningham | 52/79.1 |
| 5,237,784 | A | * | 8/1993 | Ros | 52/79.5 |
| 5,313,747 | A | * | 5/1994 | Sakihara | 52/64 |
| 5,329,667 | A | * | 7/1994 | Erskine | 16/269 |
| 5,369,920 | A | * | 12/1994 | Taylor | 52/79.1 |
| 5,375,899 | A | * | 12/1994 | Wright | 296/21 |
| 5,444,944 | A | * | 8/1995 | Roelofsz | 52/64 |
| 5,463,833 | A | * | 11/1995 | Banez | 52/71 |
| 5,474,230 | A | * | 12/1995 | Yotukura | 229/117.04 |
| 5,493,818 | A | * | 2/1996 | Wilson | 52/71 |
| 5,596,844 | A | * | 1/1997 | Kalinowski | 52/79.5 |
| 5,743,701 | A | | 4/1998 | Green | |
| 5,761,854 | A | * | 6/1998 | Johnson et al. | 52/69 |
| 5,915,446 | A | * | 6/1999 | De Zen | 160/235 |
| 5,960,593 | A | * | 10/1999 | Murphy | 52/79.5 |
| 5,964,065 | A | * | 10/1999 | Migurski et al. | 52/64 |
| 5,966,956 | A | * | 10/1999 | Morris et al. | 62/259.1 |
| 6,178,701 | B1 | * | 1/2001 | De Paepe et al. | 52/36.2 |
| 6,202,364 | B1 | * | 3/2001 | Fredette | 52/79.5 |
| 6,253,500 | B1 | * | 7/2001 | Gyllenhammar | 52/79.5 |
| 6,334,278 | B1 | * | 1/2002 | Arnold | 52/79.1 |
| 6,354,044 | B1 | * | 3/2002 | Lagace, Jr. | 52/79.5 |
| 6,434,895 | B1 | * | 8/2002 | Hosterman et al. | 52/143 |
| 6,550,491 | B1 | * | 4/2003 | Bixler et al. | 135/145 |
| 6,557,308 | B1 | * | 5/2003 | Snel | 52/79.4 |
| 6,607,421 | B1 | * | 8/2003 | Rossi | 446/478 |
| 6,712,414 | B2 | * | 3/2004 | Morrow | 296/26.01 |
| 6,766,619 | B1 | * | 7/2004 | Franz | 52/79.5 |
| 6,772,905 | B2 | * | 8/2004 | Cheng | 220/840 |
| 6,920,889 | B2 | * | 7/2005 | Carter | 135/135 |
| 6,948,280 | B2 | * | 9/2005 | Marcinkowski et al. | 52/79.1 |
| 7,195,217 | B1 | * | 3/2007 | Wadensten | 248/223.41 |
| D623,242 | S | * | 9/2010 | Greer | D21/511 |
| 8,256,443 | B2 | * | 9/2012 | Neal | 135/96 |
| 8,763,315 | B2 | | 7/2014 | Hartman et al. | |
| 2002/0083654 | A1 | * | 7/2002 | Bini | 52/66 |
| 2004/0031211 | A1 | * | 2/2004 | Becker | 52/79.5 |
| 2005/0044804 | A1 | * | 3/2005 | Bin et al. | 52/79.5 |
| 2005/0076584 | A1 | * | 4/2005 | Loranger | 52/79.5 |
| 2005/0108955 | A1 | * | 5/2005 | Howe et al. | 52/79.5 |
| 2007/0113488 | A1 | | 5/2007 | Wilson | |

OTHER PUBLICATIONS

Author Unknown, "Portable Buildings", Datasheet [online]. Porta-John Industries, Inc. [retrieved on Nov. 12, 2014]. Retrieved from the Internet: <URL: http://www.toilets.com/products/portablebuilding.htm>.

* cited by examiner

FOLDING SHED

CROSS-REFERENCE TO RELATED APPLICATIONS

The present application is a continuation patent application of U.S. patent application Ser. No. 11/776,982, filed Jul. 12, 2007 entitled "Folding Shed," which is hereby incorporated by reference in its entirety.

TECHNICAL FIELD

The field of the invention generally relates to structures, and more particularly to folding sheds.

BACKGROUND

Sheds have many practical uses, including providing storage space for tools or equipment or shelter for people or animals. However, when not being used, a shed may undesirably occupy space. Further, it may be difficult to transport an assembled shed to a site or move it to another site because of the space occupied by it. This may be solved by transporting the shed in unassembled components. This solution, however, requires the shed to be assembled at the site and/or disassembled and reassembled.

Accordingly, what is needed in the art is an improved shed.

SUMMARY

One embodiment of the present invention takes the form of a folding shed. The folding shed includes a first sidewall and a second sidewall. A first roof section is pivotally coupled with the first sidewall. A second roof section is pivotally coupled with the second sidewall. A foldable first end wall is pivotally coupled with the first sidewall, and the first end wall is pivotally coupled with the second sidewall. A foldable second end wall is pivotally coupled with the first sidewall, and the second end wall is pivotally coupled with the second sidewall. The first and second sidewalls, the first and second roof sections, and the first and second foldable end walls are configurable into a first position to define an interior of a shed. The first roof section is pivotally movable outwardly from the interior of the shed when the first and second sidewalls, the first and second roof sections, and the first and second foldable end walls are configured in the first position.

A second embodiment of the present invention takes the form of a method for configuring a folding building from an operation to a storage configuration. The method includes pivoting a first roof section of a roof of a building outwardly until a surface of the first roof section approximately abuts a first sidewall. The method further includes pivoting a second roof section of the roof outwardly until a surface of the second roof section approximately abuts a second sidewall.

DETAILED DESCRIPTION

Implementations of the present invention involve a folding shelter structure. One particular implementation is a folding shed. The folding structure may include a roof, two sidewalls, and two end walls. The roof may be divided into two sections, each section pivotally connected to a sidewall. Each end wall may be divided into two sections that are pivotally connected to each other and to the sidewall adjacent the section. The folding structure may be transformed from an operation to a storage or transport configuration by outwardly pivoting each roof section relative until the exterior surface of each roof section approximately abuts the exterior surface of the respective sidewall to which it is connected and inwardly pivoting the two sections of each end wall until the exterior sections for each end wall approximately abut each other. Once transformed into a storage or transport configuration, the structure may be readily stored or transported, especially compared to a similarly sized, fully assembled non-folding structure. The assembled folding shed may be used to store tools or equipment, provide shelter for people or animals, or serve as a green house or duck blind.

Figure 1:
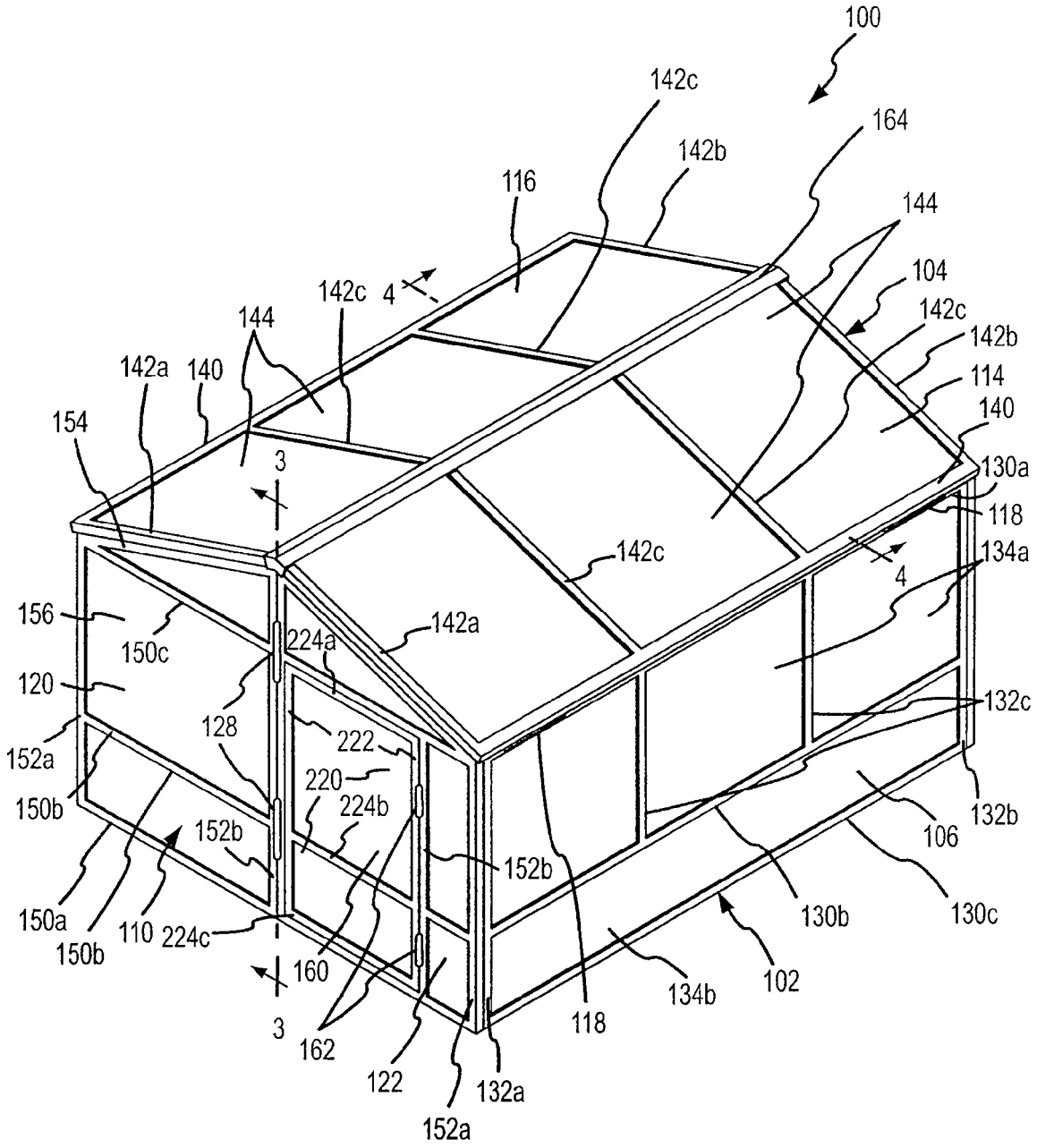
FIG. 1 depicts a front perspective view of a first example of a folding shed.
Figure 2:
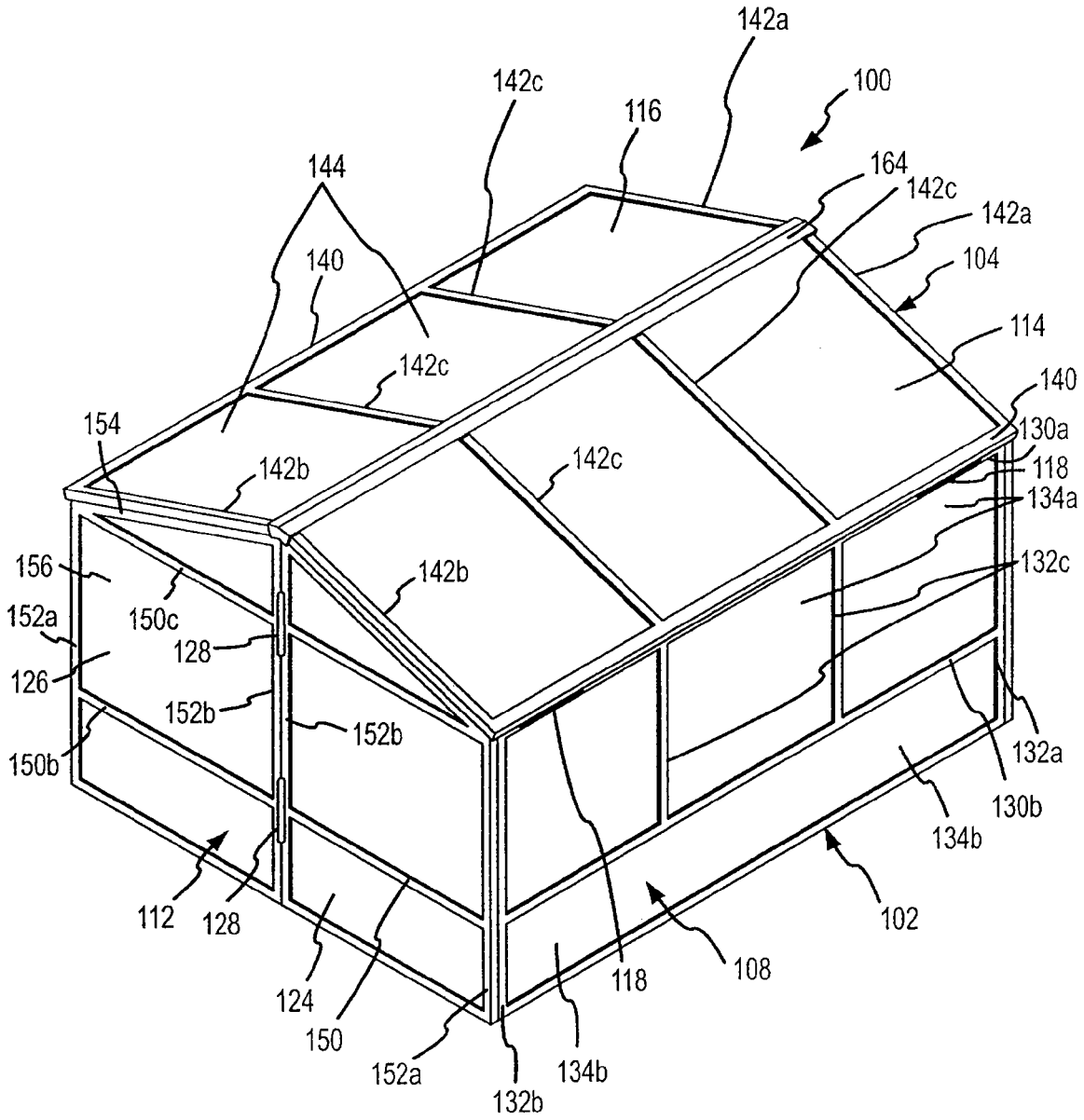
FIG. 2 depicts a rear perspective view of the folding shed depicted in FIG. 1.
Figure 11:
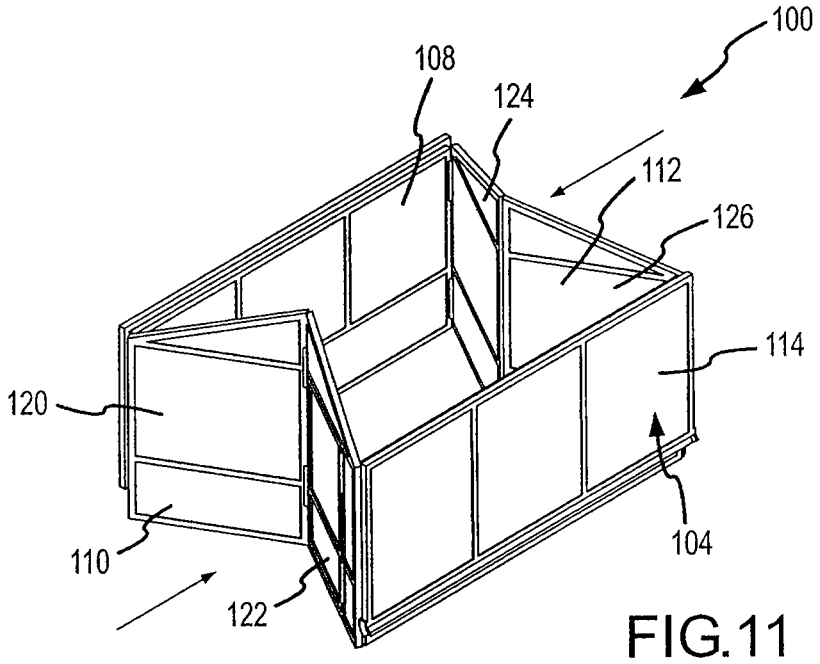
FIG. 11 depicts a front perspective view of the folding shed depicted in FIG. 1 with the front and rear end walls pivoted inwardly towards each other.

FIGS. 1 and 2 depict front and rear perspective views of a first example of a folding shed 100 in an unfolded configuration, and FIG. 11 depicts a front perspective view of the first example of a folding shed 100 in a partially folded configuration. In this example, the folding shed 100 includes a rectangular base 102 and a roof 104. The base 102 includes left and right sidewalls 106, 108 and front and rear end walls 110, 112. The roof 104 is divided into separate left and right roof sections 114, 116 with each roof section 114, 116 pivotally coupled to its respective sidewall 106, 108. In one particular arrangement, the roof sections 114, 116 are connected to the sidewall 106, 108 supporting it with one or more roof hinges 118 so that each section may be independently pivoted with respect to the sidewall 106, 108. Further, each end wall 110, 112 is divided into separate right and left end wall sections 120, 122, 124, 126. The end wall sections 120, 122, 124, 126 are connected together by one or more end wall hinges 128 so that the right and left sections of an end wall 110, 112 may be pivoted or folded relative to each other. Although the left and right roof sections 114, 116 are each shown as connected to their respective sidewalls 106, 108 by two roof hinges 118, more or less roof hinges may be used to connect each roof section 114, 116 to its respective sidewall 106, 108. Similarly, although the right and left end wall sections 120, 122, 124, 126 for the front and back end walls 110, 112 are shown as connected together by two end wall hinges 128, more or less end wall hinges may be used. Moreover, other pivoting or rotating arrangements besides hinges may be employed, such as ball and socket joints, universal joints, and so on.

With reference to FIGS. 1 and 2, the left and right sidewalls 106, 108 may be formed using horizontal and vertical sidewall members 130*a-c*, 132*a-c* with sidewall panels 134*a-b* therebetween. The horizontal and vertical sidewall members 130*a-c*, 132*a-c* may be configured to define sidewall frame structures for receiving and retaining the sidewall panels 134*a-b* as described in more detail below. Each horizontal and vertical sidewall member 130*a-c*, 132*a-c* may be joined to another horizontal or vertical sidewall member 130*a-c*, 132*a-c* by fasteners, welds, adhesives, any other known methods for joining two items together, or any combination thereof. In a similar manner, which will be described in more detail below, the roof 104 may be formed using horizontal and sloping roof members 140, 142*a-c* with roof panels 144 therebetween, and each end wall 110, 112 may be formed using horizontal, vertical, and sloping end wall members 150*a-c*, 152*a-b*, 154 with end wall panels 156 therebetween. The number and arrangement of sidewall, roof and end wall members will depend on various factors, including the desired overall weight for the structure or any particular part of the structure, the desired rigidity or size of the structure, visual or other aesthetic considerations, cost and availability of materials, and so on.

The folding shed 100 may also include a door 160 connected to the front end wall 110 by one or more door hinges 162 to enable entry into and out of the shed 100. Although the door 160 is shown as connected to the front end wall 110 by two door hinges 162, more or less door hinges may be used. Also, although only one door 160 is shown, the folding shed may include one or more doors or windows, which may located in any of the end walls 110, 112 or sidewalls 106, 108.

When the left and right roof sections 114, 116 are configured in a closed position as shown in FIGS. 1 and 2, a joint is formed between them at the peak of the roof 104. Water from rain, hoses, or other water sources may leak through this joint. To minimize water leakage through it, a roof plate 164 may be placed over the joint along the joint's length. Although only one roof plate 164 is shown, more than one roof plate may be used to prevent water leakage through the roof joint. Additionally, other devices or methods for sealing a joint to prevent water leakage through it may be used in lieu of, or in combination with, the roof plate 164.

Figure 3:
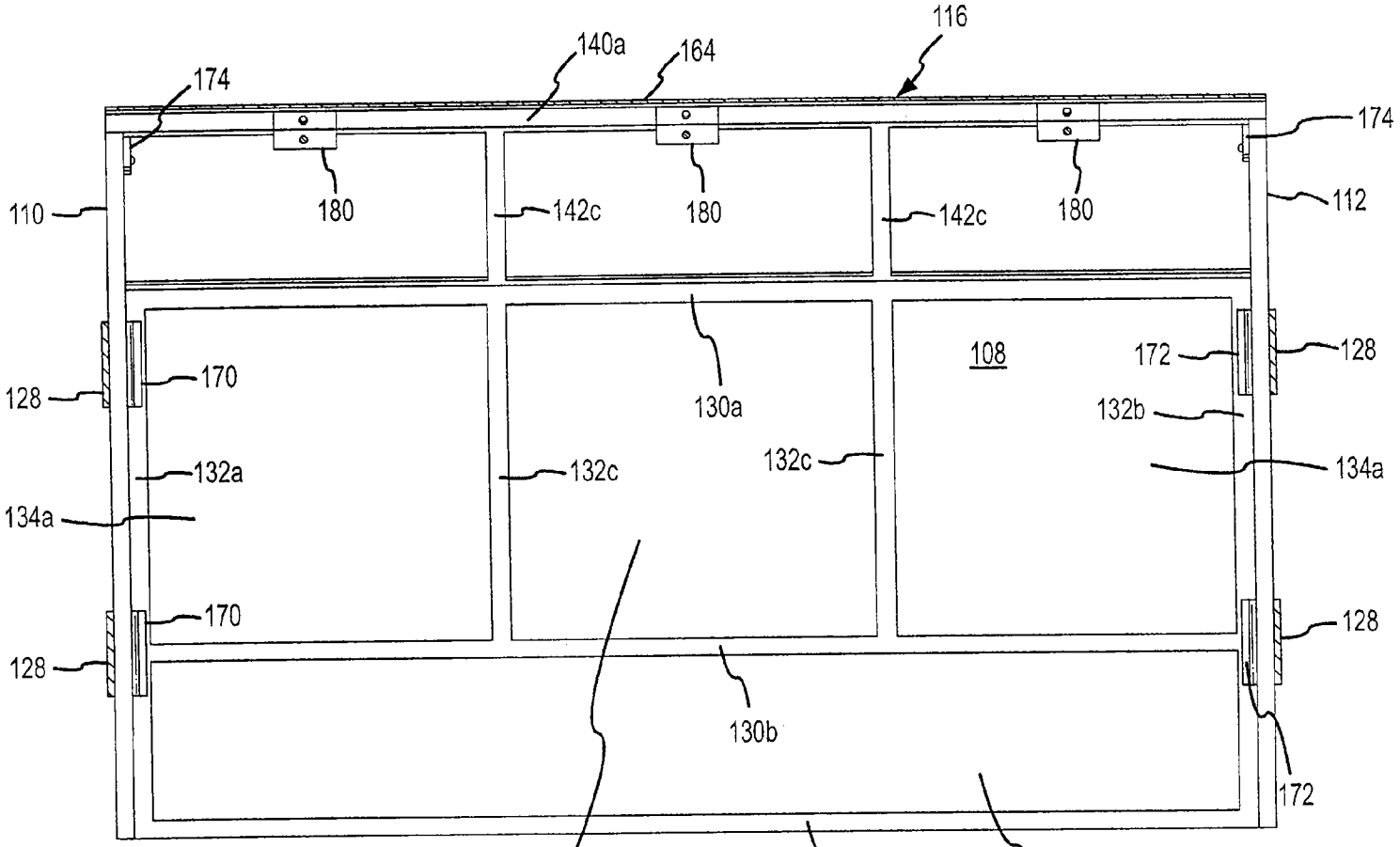
FIG. 3 depicts a cross-sectional view of the folding shed depicted in FIG. 1 viewed along line 3-3.

FIG. 3 depicts a cross-sectional view of the folding shed 100 depicted in FIGS. 1 and 2 viewed along line 3-3. The right sidewall 108 may be pivotally connected to the front end wall 110 using one or more front sidewall hinges 170. The right sidewall 108 may also be pivotally connected to the rear end wall 112 using one or more rear sidewall hinges 172 Like the right sidewall 108, the left sidewall 106 may also be pivotally connected to the front and rear end walls 110, 112 using front and rear sidewall hinges 170, 172.

When the right roof section 116 is in a closed position, it may be secured to the front and rear end walls 110, 112 using end wall connectors 174, such as a latches. Securing the right roof section 116 to the front end wall 110, the rear end wall 112, or both end walls 110, 112 prevents the right roof section 116 from being undesirably separated from the end walls 110, 112. For example, wind uplift forces could cause the right roof section 116 to be lifted away from the front and rear end walls 110, 112 if not positively connected to at least one of the end walls 110, 112. As shown in FIG. 3, the right roof section 116 is secured to both the front and rear end walls 110, 112. However, the right roof section 116 may be secured to only the front end wall 110 or to only the rear end wall 112. The left roof section 114 may also be secured either the front end wall 110, the rear end wall 112, or both, in a manner similar to the right roof section 116.

Figure 5:
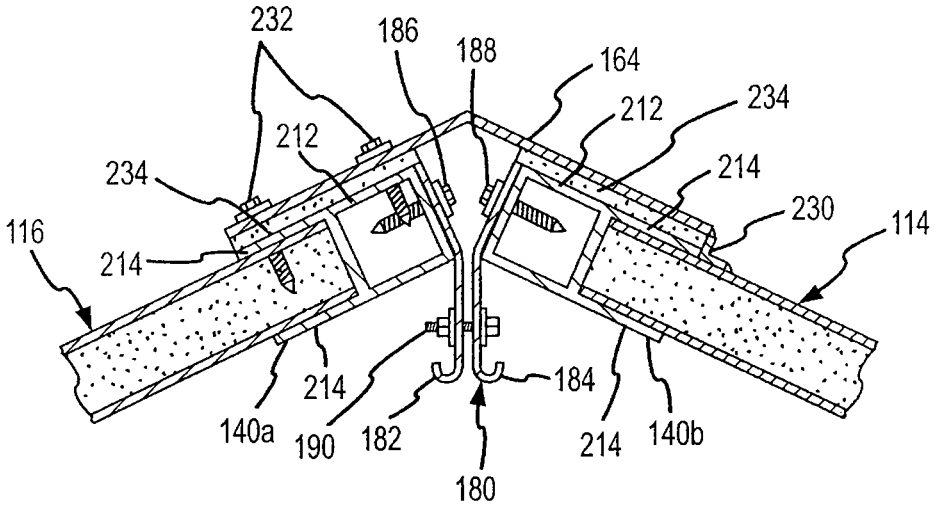
FIG. 5 depicts a side elevation view of the roof peak of the folding shed depicted in FIG. 1.

In the unfolded orientation, roof connectors 180 are provided to join the right and left roof sections 114, 116. As shown in FIG. 5, a roof connector 180 may include right and left roof connector plates 182, 184. The right roof connector plate 182 may be connected to the right horizontal top roof member 140*a* using a first roof connector fastener 186, such as a bolt, screw or the like. Similarly, the left connector plate 184 may be connected to the left top horizontal roof member 140*b* using a second roof connector fastener 188. When the right and left roof sections 114, 116 are both in a closed position as shown in FIG. 5, the right and left roof connector plates 182, 184 may be connected together using a third roof connector fastener 190. In some embodiments, one of the plates 182, 184 has a latch biased into a closed position and the other a pin for snap joining the roof connector plates 182, 184 together. By using a roof connector 180, the right and left roof sections 114, 116 may be prevented from moving towards the interior of the folding shed under the influence of gravity or other downward forces, or away from the interior of the shed under the influence of wind uplift or other upward forces when the left and right roof sections 114, 116 are in a closed position.

Although the roof connector 180 is depicted as including two roof connector plates 182, 184, the roof connector 180 could be formed using more or less plates or using different components. For example, the left and right roof sections 114, 116 may be connected together using a single plate that is connected to both roof sections. As another example, the left and right sections 114, 116 may be connected together using a tie rod connected to each section 114, 116. Further, although the roof connector plates 182, 184 are depicted as mechanically fastened to the right and left roof sections 114, 116 and to each other, other known methods of joining two items together such as welding or adhering, or a combination of other known methods, could be used to join the roof connector plates 182, 184 to the right and left roof sections 114, 116 and to each other. Similarly, alternative forms of the roof connector 180 (e.g., the tie rod) could be mechanically fastened, welded, adhered, joined by other known methods for joining two items together, or joined by a combination thereof. The roof connectors 180 may also be omitted. If omitted, the left and right roof sections 114, 116 may be directly connected to each other without the use of an intermediate component such as a roof connector 180, or may not be connected together.

Generally, the roof connectors 180 form a more stable roof by structurally tying the right and left roof sections 114, 116 together. Columns (not shown) may also be used to support the roof 104, especially for larger sheds. The columns could be connected to the roof 104 by welding or adhering the columns to the roof members 140*a-b*, 142*a-c*, 144, using mechanical fasteners, such as bolts or screws, to join the columns to the roof members 140*a-b*, 142*a-c*, 144, using any other suitable method of joining two or more components together, or any combination thereof.

Figure 4:
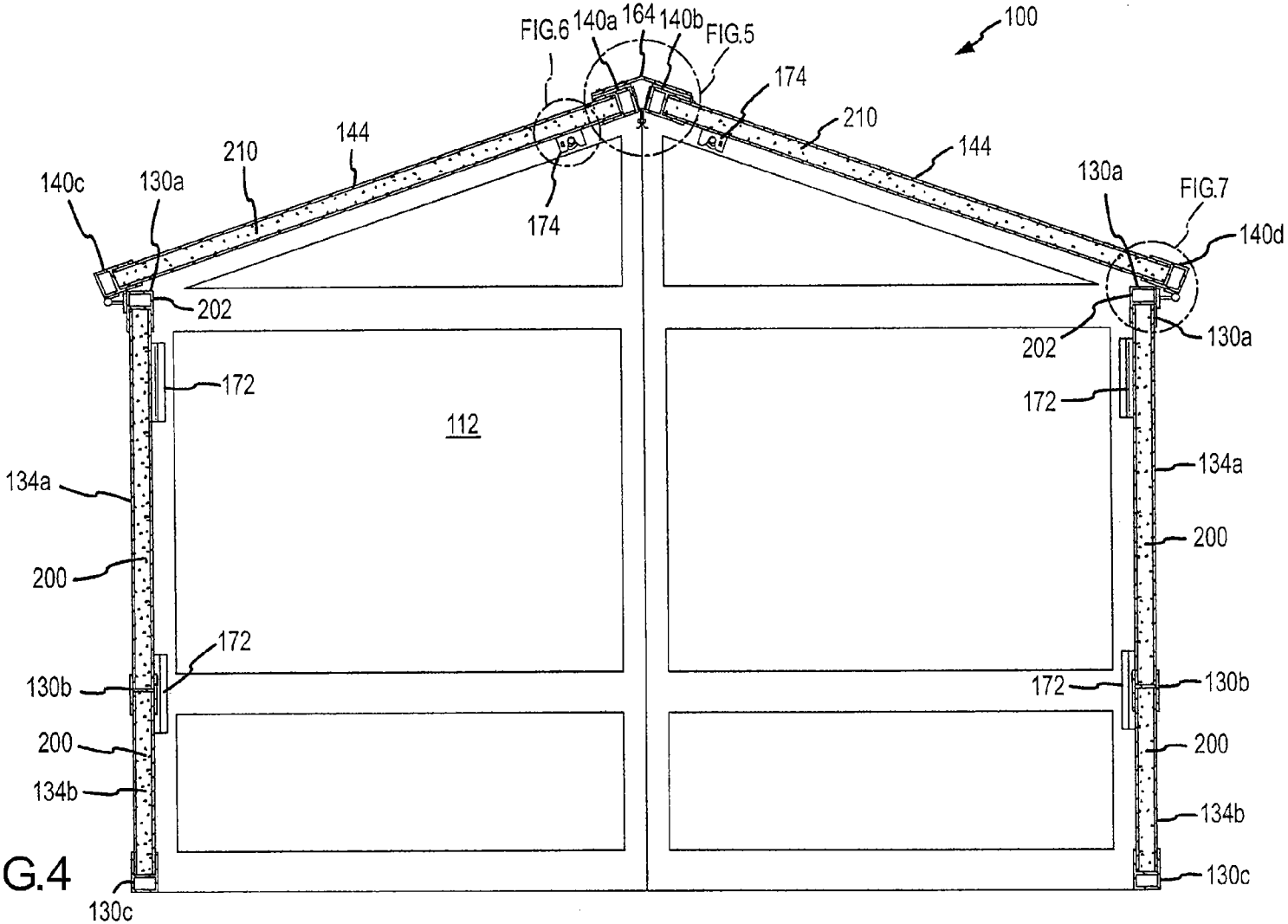
FIG. 4 depicts a cross-sectional view of the folding shed depicted in FIG. 1 viewed along line 4-4.

FIG. 4 depicts a cross-sectional view of the folding shed 100 depicted in FIG. 1 viewed along line 4-4. As shown in FIG. 4, upper sidewall panels 134*a* may span between top and intermediate horizontal sidewall members 130*a, b*, and lower sidewall panels 134*b* may span between intermediate and bottom horizontal sidewall members 130*b, c*. The sidewall panels 134*a, b* may contain a sidewall filler 200 to maintain the spaced relationship between plates forming the sidewall panels 134*a, b*, to enhance the structural integrity of the sidewall panels 134*a, b* (e.g., to reduce the tendency of the plates forming a sidewall panel to buckle), to provide insulation for the folding shed 100, to soundproof the folding shed 100, to increase the weight of the folding shed 100 to resist uplift or overturning forces, to increase the fire resistance of the folding shed 100, or to do a combination thereof. One or more stiffener plates (not shown) may also located between plates forming the sidewall panels 134*a, b* to maintain the plates' spaced relationship or to enhance the panel's structural integrity. Although each sidewall panel 134*a, b* is shown as including a sidewall filler 200, the sidewall filler 200 may be omitted from any or all of the sidewall panels 134*a, b*. Similarly, stiffener plates may be omitted from any or all of the sidewall panels 134*a, b*.

With reference to FIG. 4, the top horizontal sidewall members 130*a* may have generally rectangular, hollow cross-sectional bodies 202. As shown best in FIG. 7, a pair of opposing, generally parallel plates 204*a, b* may extend vertically downward from each top horizontal sidewall member body 202 to define generally U-shaped channels for receiving top end portions of the upper sidewall panels 134*a*. The top horizontal sidewall member plates 204*a, b* may be integral with their respective top horizontal sidewall member body 202 or may be separate components connected to their respective top horizontal sidewall member body 202 by fasteners, welds, adhesives, any other known method for joining two members together, or a combination thereof. Further, each top horizontal sidewall member 130*a* may be integral along its length or may be made up of multiple, separate components that are connected together by fasteners, welds, adhesives, any other known method for joining two members together, or any combination thereof. Referring back to FIG. 4, the bottom horizontal sidewall members 130*c* may be generally similar to the top horizontal sidewall members 130*a* except their generally parallel plates may extend vertically upward from generally rectangular, hollow bodies to define generally U-shaped channels for receiving bottom end portions of the lower sidewall panels 134*b*.

With further reference to FIG. 4, the intermediate horizontal sidewall members 130*b* may have generally H-shaped cross-sectional areas that define upper and a lower U-shaped channels. The upper U-shaped channels may receive bottom end portions of upper sidewall panels 134*a* while the lower U-shaped channels may receive top end portions of the lower sidewall panels 134*b*. Each intermediate horizontal sidewall member 130*b* may be formed as single member or may be formed from separate components (e.g., three plates configured to form an H-shaped cross-sectional area) connected together by fasteners, welds, adhesives, any other known method for joining two members together, or a combination thereof. Further, each intermediate horizontal sidewall member 130*b* may be integral along its length or may be made up of multiple, separate components that are connected together by fasteners, welds, adhesives, any other known method for joining two members together, or any combination thereof.

The exterior vertical sidewall members 132*a, b* (see FIGS. 1 and 2 for locations) may generally resemble the top and bottom sidewall horizontal members 130*a, c* and may generally receive end portions of sidewall panels 134*a, b* within U-shaped channels. The interior vertical sidewall members 132*c* (see FIGS. 1 and 2 for locations) may generally resemble the intermediate horizontal sidewall members 130*b* and may generally receive end portions of sidewall panels 134*a* within U-shaped channels.

The horizontal and vertical sidewall members 130*a-c*, 132*a-c* may be configured to define sidewall frame structures as shown in FIGS. 1 and 2. The U-shaped channels, which are generically shown in FIGS. 4 and 7, for each horizontal and vertical sidewall member 130*a-c*, 132*a-c* that forms a sidewall frame structure may collectively define a tongue and groove system for connecting the sidewall panels 134*a-b* to the sidewall frame structure. For example, the intermediate and bottom horizontal left sidewall members 130*b-c* and the front and rear exterior vertical left sidewall members 132*a-b* may together define a groove encompassing the outer perimeter of the lower left sidewall panel 134*b* when top, bottom, left, and right end portions of the lower sidewall panel 134*b* are received within the U-shaped grooves of the intermediate horizontal left sidewall member 130*b*, the bottom horizontal left sidewall member 130*c*, the front exterior vertical left sidewall member 134*a*, and the rear exterior left vertical sidewall member 134*b*, respectively. Because the outer perimeter of the lower left sidewall panel 134*b* is encompassed by these left sidewall members 130*b-c*, 132*a-b*, the lower left sidewall panel 134*b* is retained with the left sidewall frame structure, thereby effectively connecting the lower left sidewall panel 134*b* to the sidewall frame structures. Other left and right sidewall panels 134*a, b* may have their outer perimeters similarly encompassed by left and right sidewall horizontal and vertical members 130*a-c*, 132*a-c*, thereby retaining them within their respective left and right sidewall frame structures.

As shown in FIG. 4, roof panels 144 may span between top and bottom roof members 140*a-d*. The roof panels 144 may be formed from interior and exterior roof panel plates.

The roof panels 144 may include roof filler 210 to maintain the spaced relationship between the plates forming the panels 144, to enhance the structural integrity of the roof panels 144 (e.g., to reduce the tendency of the plates forming a roof panel 144 to buckle), to provide insulation for the folding shed 100, to soundproof the folding shed 100, to increase the weight of the folding shed 100 to resist uplift or overturning forces, to increase the fire resistance of the folding shed 100, or to do a combination thereof. One or more stiffener plates (not shown) may also located between the plates forming the roof panels 144 to maintain the plates' spaced relationship or to enhance the roof panels' structural integrity. Although the roof panels 144 are shown as including a roof filler 210, the roof filler 210 may be omitted from any or all of the roof panels 144. Similarly, stiffener plates may be omitted from any or all of the roof panels 144.

The top and bottom horizontal roof members 140*a-d* may generally resemble the top and bottom horizontal sidewall members 130*a, c*, which are best shown in FIG. 4. In particular and with reference to FIG. 5, the top horizontal roof members 140*a, b* may have generally rectangular, hollow cross-sectional bodies 212. A pair of opposing, generally parallel plates 214 may extend downward from each top horizontal roof member body 212 to define a generally U-shaped channel for receiving a top end portion of a roof panel 144. The top horizontal roof member plates 214 may be integral with their respective top horizontal roof member body 212 or may be separate components connected to their respective top roof member body 212 by fasteners, welds, adhesives, any other known method for joining two members together, or a combination thereof. Further, each top horizontal roof member 140*a-b* may be integral along its length or may be multiple, separate components that are connected together by fasteners, welds, adhesives, any other known method for joining two members together, or a combination thereof. Turning back to FIG. 4, the bottom horizontal roof members 140*c-d* may be generally similar to the top horizontal roof members 140*a-b* except the generally parallel plates may extend upward from generally rectangular, hollow bodies to define a generally U-shaped channels for receiving bottom end portions of roof panels 144.

The front and rear sloping roof members 142*a, b* (see FIGS. 1 and 2 for locations) may generally resemble the top and bottom horizontal roof members 130*a, c* and may generally receive end portions of roof panels 144 within U-shaped channels. The interior sloping roof members 142*c* may generally resemble the intermediate horizontal sidewall members 130*b* (i.e., have H-shaped cross-sectional areas) and may generally receive end portions of roof panels 144 within U-shaped channels.

The horizontal and sloping roof members 142*a-c* may be configured to define a roof frame structure as shown in FIG. 1. As discussed above with respect to the sidewall horizontal and vertical members 130*a-c*, 132*a-c*, the U-shaped channels for each horizontal and sloping roof member 140*a-d*, 142*a-c* may collectively define a tongue and groove system for connecting the roof panels 144 to the roof frame structure in a manner similar to the one described above for the sidewalls 106, 108.

The front and rear end walls 110, 112 may be created in a manner similar to the left and right sidewalls 106, 108. In particular, the end wall panels 156 may include interior and exterior end wall panel plates with end wall filler located between them. Like the sidewall filler, the end wall filler may be used to maintain the spaced relationship between the interior and exterior end wall panel plates, to enhance the structural integrity of the end wall panel plates (e.g., to reduce the tendency of the end wall panel plates to buckle), to provide insulation for the folding shed 100, to soundproof the folding shed 100, to increase the weight of the folding shed 100 to resist uplift or overturning forces, to increase the fire resistance of the folding shed 100, or to do a combination thereof. One or more stiffener plates may also located between the interior and exterior end panel plates to maintain their spaced relationship or to enhance their structural integrity. The end wall filler may be omitted from any or all of the end wall panels 156, and the stiffener plates may be omitted from any or all of the end wall panels 156.

The exterior and interior vertical end wall members 152*a, b* may generally resemble the exterior vertical sidewall members 132*a, b*, the sloping and bottom horizontal end wall members 154, 150*a* may generally resemble the top and bottom horizontal sidewall members 130*a, c*, and the intermediate and top horizontal end wall members 150*b, c* may generally resemble the intermediate horizontal sidewall members 130*b*. As required, vertical and horizontal end wall members 152*b*, 150*a, c*, adjacent the door 160 may have slightly modified cross-sectional areas to accommodate the door 160. For example, the portion of the top horizontal front end wall member 150*c* adjacent the door 160 may have a rectangular, hollow cross-sectional area with a pair of opposing plates extending vertically upward from the rectangular cross-sectional area rather than an H-shaped cross-sectional area.

The horizontal, vertical and sloping end wall members may be configured to define end wall frame structures as shown in FIGS. 1 and 2. As discussed above with respect to the sidewalls 106, 108, the U-shaped channels for each horizontal, vertical, and sloping end wall member 150*a-c*, 152*a-b*, 154 may collectively define a tongue and groove system for connecting the end wall panels 156 to the end wall frame structures in a manner similar to the one described above for the sidewalls 106, 108.

The right or left front end wall sections 120, 122 may include a sliding bar (not shown). The other front end wall section 122, 120 may include a slot (not shown) or other suitable means for receiving the sliding bar. When the shed is configured in the unfolded position as shown in FIGS. 1 and 2, the bar is received within the slot to maintain the alignment of the right and left sections 120, 122 of the front end wall 110. The rear end wall 112 may also have a sliding bar and slot to maintain the alignment of the right and left sections 124, 126 of the rear end wall 112 when the shed is configured in its unfolded position.

The door 160 may be created in a manner similar to the left and right sidewalls 106, 108. In particular, the door panels 220 may include interior and exterior door panel plates with door filler located between them. Like the sidewall filler, the door filler may be used to maintain the spaced relationship between the interior and exterior door panel plates, to enhance the structural integrity of the door panel plates (e.g., to reduce the tendency of the door panel plates to buckle), to provide insulation for the folding shed 100, to soundproof the folding shed 100, to increase the weight of the folding shed 100 to resist uplift or overturning forces, to increase the fire resistance of the folding shed 100, or to do a combination thereof. One or more stiffener plates may also located between the interior and exterior door panel plates to maintain their spaced relationship or to enhance their structural integrity. The door filler may be omitted from any or all of the door panels 220, and the stiffener plates may be omitted from any or all of the door panels 220.

The vertical door members 222 may generally resemble the exterior vertical sidewall members 132*a-b*, the top and bottom horizontal door members 224*a, c* may generally resemble the top and bottom horizontal sidewall members 130*a, c*, and the intermediate horizontal door member 224*b* may generally resemble the intermediate sidewall member 130*b*.

The horizontal and vertical door members 222, 224*a-c* may be configured to define a door frame structure as shown in FIG. 1. As described above for the sidewalls 106, 108, the U-shaped channels for each horizontal and vertical door member 222, 224*a-c* may collectively define a tongue and groove system for connecting the door panels 220 to the door frame structure in a manner similar to the one described above for the sidewall.

Any or all of the end wall, sidewall, roof, and door panels 156, 134*a-b*, 144, 220 may include one or more openings through their respective interior or exterior panel plates. These openings may be used to selectively insert or remove filler from panels containing such openings and may be selectively closable. Selectively inserting or removing filler from one or more of the panels may be useful to minimize the weight of the folding shed 100 during transport, and/or to periodically replace or repair filler.

The end wall, sidewall, roof, and door members and panel plates may be made of metal, wood, plastic, concrete, any other suitable material, or any combination thereof. The end wall, sidewall, and roof filler may be foam, insulation, sand, any other suitable material, or any combination thereof.

A method of pre-assembling a left sidewall 106 for use with the folding shed will be now be described. First, the bottom horizontal sidewall member 130*c* may be connected to the exterior vertical sidewall members 132*a-b*. The lower sidewall panel 134*b* may then be received within the U-shaped channels of the bottom horizontal sidewall member 130*c* and the exterior vertical sidewall members 132*a-b*. The intermediate horizontal member 130*b* may then be connected to the exterior vertical sidewall members 132*a-b* with the upper portion of the bottom sidewall panel 134*b* received within the U-shaped channel of the intermediate horizontal member 130*b*. The interior vertical sidewall members 132*c* may be connected to the intermediate horizontal member 130*b*. The upper sidewall panels 134*a* may then be received within the U-shaped channels of the intermediate horizontal sidewall member 130*b*, the exterior vertical sidewall members 132*a-b*, and/or the interior sidewall members 132*c*. The top horizontal sidewall member 130*a* may be connected to the exterior and interior vertical sidewall members 132*a-c* with the upper portion of the upper sidewall panels 134*a* received within the U-shaped channel of the top horizontal sidewall member 130*a*. The horizontal and vertical sidewall members 130*a-c*, 132*a-c* may be connected together by fasteners, welds, adhesives, any other known method for joining two members together, or a combination thereof.

Although assembly of the left sidewall 106 has been described with members and panels connected together in a certain order, the order of assembly could be different. For example, the bottom sidewall panel 134*b* could be received within the bottom horizontal sidewall member 130*c*, and then the exterior vertical sidewall members 132*a-b* could be connected to the bottom horizontal member 130*c*. As another example, the intermediate horizontal sidewall member 130*b* could be connected to the interior and exterior vertical members 132*a-c*, and then the lower and upper sidewall panels 134*a-b* could be received within the U-shaped grooves of the intermediate horizontal sidewall member 130*b* and the exterior and interior vertical members 132*a-c*.

The right sidewall 108, the roof 104, the front and rear end walls 110, 112, and the door 160 may be pre-assembled in a manner similar to that described for the left sidewall 108 for use as part of the folding shed 100. Once the left and right sidewalls 106, 108, the front and rear end walls 110, 112, the roof 104, and the door 160 are assembled, they may be connected together using hinges 118, 128, 162, 170, 172 as shown in FIGS. 1, 2, and 3 to form the folding shed. Although the assembly of the folding shed 100 has been described as occurring in a certain order, the order of assembly could be different. For example, some or all of the end wall, sidewall, roof, and door members that are connected together by hinges may first be connected together with their respective hinges 118, 128, 162, 170, 172, and then the end walls 110, 112, sidewalls 106, 108, roof 104, and door 160 could be assembled.

Although the shape and configuration for members forming each frame structure for the sidewalls 106, 108, end walls 110, 112, roof 104, and door 160 have been described with a certain specificity, other shapes and configurations may be used for any or all of the members. Further, although a tongue and groove system has been described for connecting the panels 134*a-b*, 144, 156, 220 for the sidewalls 106, 108, end walls 110, 112, roof 104, and door 160 to their respective frame structures, other methods of connecting the panels 134*a-b*, 144, 156, 220 to the frame structure may be used in lieu of, or in combination with, the tongue and groove system described above including connecting the panels 134*a-b*, 144, 156, 220 to their respective supporting frame structures by mechanical fasteners, welds, adhesives, any other known method to join two items together, or any combination thereof. Yet further, although the sidewalls 106, 108, end walls 110, 112, roof 104, and door 160 have been depicted in FIGS. 1, 2, 3, and 4 and other figures as being a certain frame and panel structure, any or all may be created using any wall, roof, or door construction method used to create a structure. For example, a wood framing structure with plywood connected to the exterior side of the wood framing may be used for any or all of the sidewalls, end walls, roof, or the door. As another example, lightweight pre-cast concrete panels may be used to create any or all of the sidewalls, end walls, the roof, or the door for the folding shed. As yet another example, the sidewalls and end walls could be formed from a molded plastic that resembles the logs of a log cabin.

With reference to FIG. 5, the roof plate 164 may be connected to the left roof section 114 using a roof plate connection member 230. In particular, the roof plate connection member 230 may be welded to the left roof section 114 and the roof plate 164. The roof plate connection member 230 may be an angle as shown in FIG. 5, a plate, or any other suitably shaped member. Further, more than one roof plate connection member 230 may be used. The roof plate 164 may be connected to the right roof section 116 using one or more roof plate fasteners 232. A water sealant 234 may be located between the roof plate 164 and the right and left sections 114, 116. The water sealant 234 helps prevent water from passing through the joint formed between the roof plate 164 and the right and left roof sections 114, 116. The combination of the roof plate 164 and the water sealant 234 may be used to prevent water from entering the joint formed between the left and right roof sections 114, 116 when the sections 114, 116 are configured in a closed position.

The roof plate 164 may be made of metal, wood, plastic, concrete, any other suitable material, or any combination thereof. The water sealant 234 may be made of rubber, plastic, or any other suitable material.

Methods of joining the roof plate 164 to the right and left roof sections 114, 116 other than the method depicted in FIG. 5 and described above may be used. For example, the roof plate 164 could be connected to both the left and right roof sections 114, 116 by roof plate fasteners 232. As another example, the roof plate 164 could be connected to the left and right roof sections 114, 116 by gluing the roof plate 164 to the water sealant 234 and gluing the water sealant 234 to the left and right roof sections 114, 116.

Methods of preventing water from passing through the joint formed between the left and right roof sections 114, 116 when the sections 114, 116 are configured in a closed position other than the one depicted in FIG. 5 and described above may be used. For example, a first waterproof material (e.g., rubber) may be connected to the left roof section 114 and a second waterproof material may be connected to the right roof section 116. Continuing with the example, the first and second waterproof materials may be configured to be pressed together when the roof sections 114, 116 are in a closed position in order to create a watertight seal at the joint formed between the roof sections 114, 116. As another example, a waterproof material could be configured to form a shape similar to the shape of the roof plate 164 depicted in FIG. 5 and connected to the roof sections 114, 116 by fasteners.

Figure 6:
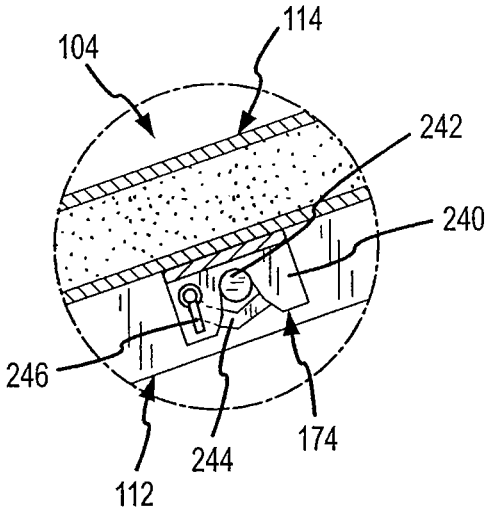
FIG. 6 depicts a front elevation view of an end wall connector for the folding shed depicted in FIG. 1.

FIG. 6 depicts a detailed view of an end wall connector 174, which may be used to prevent the roof 104 from being undesirably separated from the end walls 110, 112 when the roof 104 is in a closed position. The end wall connector 174 may include an end wall connector plate 240 connected to the roof 104 by welding the plate 240 to the roof 104. Although depicted as connected to the roof 104 by welds, the plate 240 could be connected to the roof 104 by use of fasteners, adhesives, any other known method of connecting two members together, or any combination thereof. The end wall connector plate 240 may include a slot for receiving a peg 242 connected to the end wall 112. The peg 242 may be connected to the end wall 112 using mechanical fasteners, welds, adhesives, any other known connection method, or any combination thereof.

Attached to the plate 240 may be a latch 244 that forms an enclosed space with the slot in the end wall connector plate 240 for retaining the peg 242 within the slot. The latch 244 may be generally biased by a spring or other suitable device into a closed a position and may be connected to a latch handle 246 that permits the latch 244 to be moved from the closed position to an open position. To receive the peg 242 within the slot, the latch 244 may be moved to an open position as the roof 104 is moved into its closed position. Once the peg 242 is received within the slot, the latch 244 may be returned to its closed position (e.g., for example, by releasing the handle 246 if the latch 244 is biased to the closed position), thereby retaining the peg 242 within the enclosed space formed by the slot and the latch 244. The latch 244 may be configured to be moved into an open position by contact with the peg 242 as the roof 104 is moved into a closed position. Once the peg 242 clears the latch 244, the latch 244 may then be biased by a spring or other suitable device to return the latch 244 to its closed position. Methods other than the one depicted in FIG. 6 and described above may be used to prevent the roof 104 from being undesirably separated from the end walls 110, 112 when the roof 104 is configured in a closed position.

Figure 7:
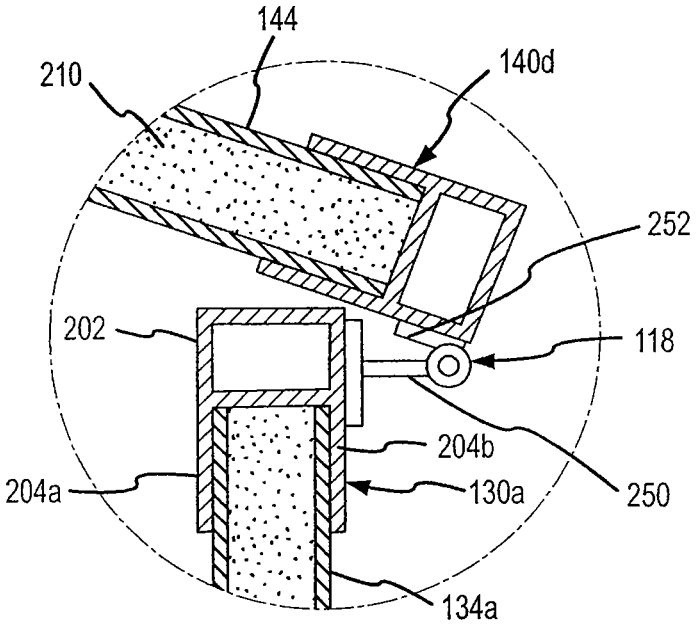
FIG. 7 depicts a side elevation view of a roof hinge for the folding shed depicted in FIG. 1.
Figure 8:
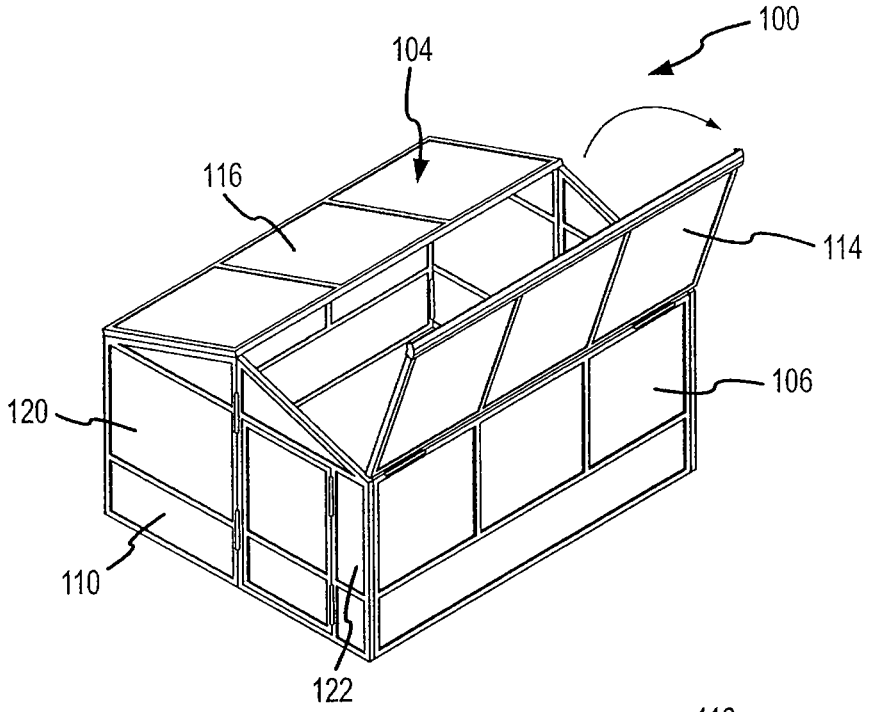
FIG. 8 depicts a front perspective view of the folding shed depicted in FIG. 1 showing the left roof section partially opened.

FIG. 7 depicts a side elevation view of a roof hinge 118 for the folding shed 100 depicted in FIGS. 1 and 2. The roof hinge 118 may include a side wall hinge plate 250 pivotally connected to a roof hinge plate 252. The side wall hinge plate 250 may be configured to form T-shaped cross-section and may be connected to the top horizontal sidewall member 130*a* by welds. Although the side wall hinge plate 250 is depicted as connected to the top horizontal sidewall member 130*a* by welds, it may be connected to the top horizontal sidewall member 130*a* using mechanical fasteners, adhesives, any other known method for joining two items together, or any combination thereof. Similarly, the roof hinge plate 252 may be connected to the bottom horizontal roof member 140*d* using mechanical fasteners, welds, adhesives, any other known method for connecting two items together, or any combination thereof. Although the roof hinge 118 is depicted as a T-shaped side wall hinge plate 250 pivotally connected to a roof hinge plate 252, any other method for forming a hinged connection may be used to form a pivot connection between the sidewalls 106, 108 and the roof 104.

A method for transforming the folding shed 100 depicted in FIGS. 1-7 from an operation configuration to a storage or transport configuration will now be described with reference to FIGS. 8 through 13. If required, any connections between the left and right roof sections 114, 116 to each other or to the sidewalls 106, 108 or end walls 110, 112 (other than the hinged connections between the roof 104 and the sidewalls 106, 108) are undone. For example, if the roof connector 180 depicted in FIG. 5 is utilized, then the third roof fastener 190 may be removed in order to disconnect the right and left roof connector plates 182, 184 from each other. Similarly, if the roof plate 164 depicted in FIG. 5 is utilized, the roof plate fasteners 232 may be removed to disconnect the roof plate 164 from the right roof section 116. As yet another example, if the end wall connector 174 depicted in FIG. 6 is utilized, then the latch 244 may be moved into an open position to allow the peg 242 to be removed from the slot in the end wall connector plate 240.

Figure 9:
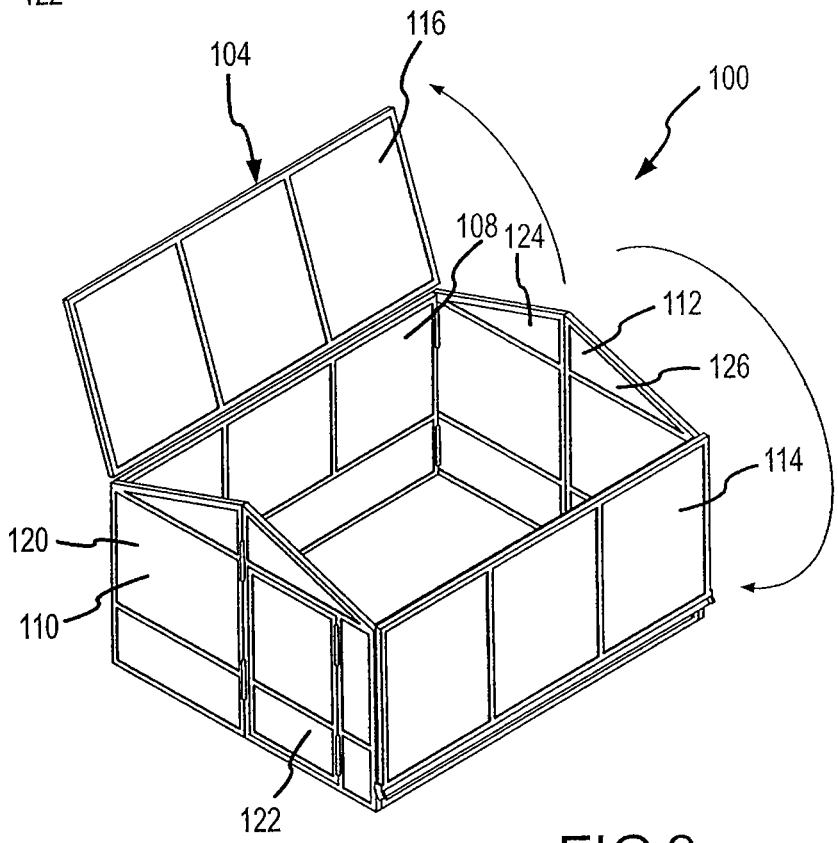
FIG. 9 depicts a front perspective view of the folding shed shown in FIG. 1 with the left and right roof sections shown in opened positions.
Figure 10:
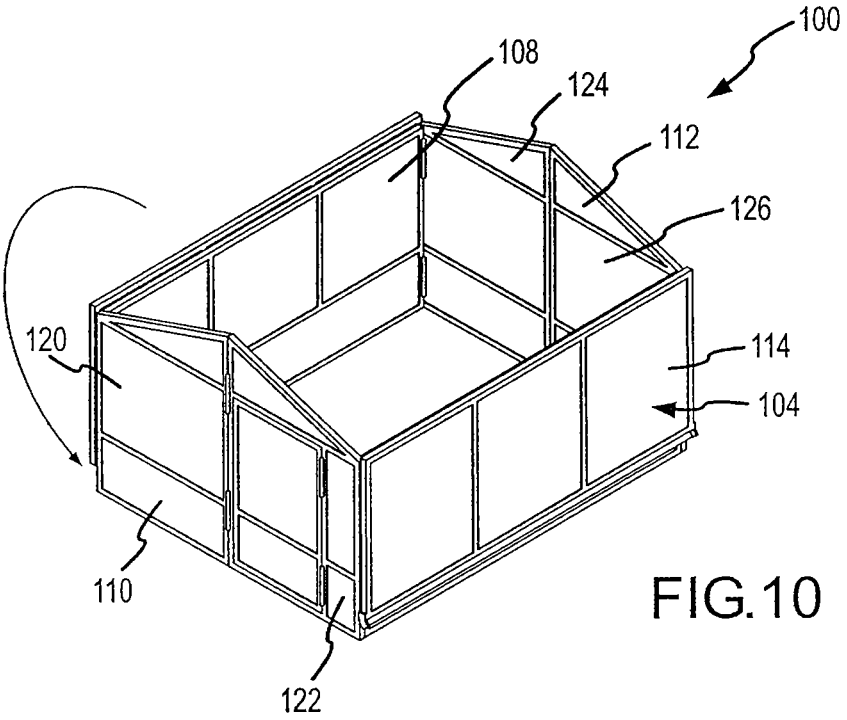
FIG. 10 depicts a front perspective view of the folding shed shown in FIG. 1 with the left and right roof sections abutting the left and right sidewalls respectively.
Figure 12:
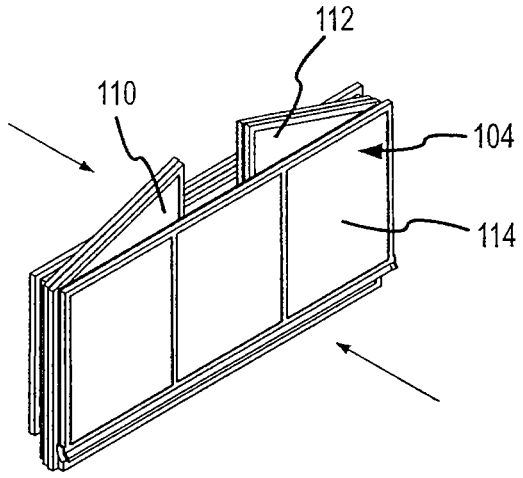
FIG. 12 depicts a front perspective view of the folding shed depicted in FIG. 1 with the left and right sections of the front and rear end walls abutting each other.
Figure 13:
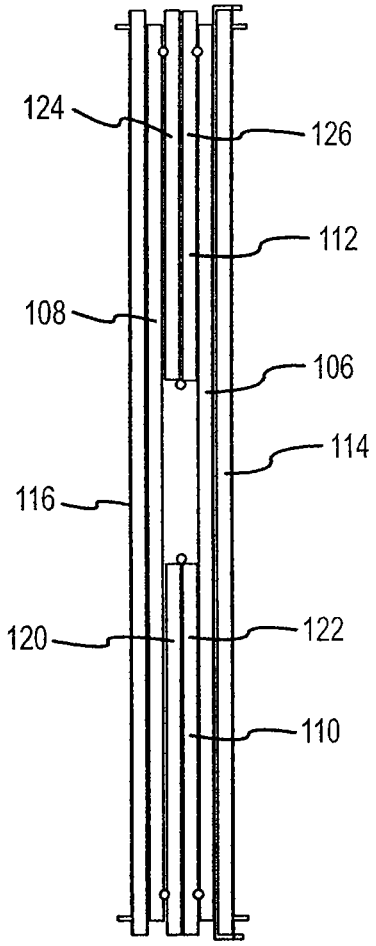
FIG. 13 depicts a top plan view of the folding shed depicted in FIG. 1 with the folding shed in a storage or transport configuration.

After disconnecting any connections between the left and right sections 114, 116 to each other and to the sidewalls 106, 108 and end walls 110, 112, the left roof section 114 may be pivoted outwardly relative to the left sidewall 106 until its exterior surface approximately abuts the exterior surface of the left sidewall 106 as shown in FIG. 9. The right roof section 116 may then be pivoted outwardly relative to the right sidewall 108 until its exterior surface approximately abuts the exterior surface of the right sidewall 108 as shown in FIG. 10. After the exterior surfaces of the left and right roof sections 114, 116 approximately abut the exterior surfaces of their respective sidewalls 106, 108, any connections between the sidewalls 106, 108 and end walls 110, 112 to each other, to the ground or a foundation (other than the hinged connections between the end walls to each other or the sidewalls 106, 108) are undone. Once these connections, if any, are undone, the right and left sections 120, 122, 124, 126 of the front and rear end walls 110, 112 may be moved inwardly toward the interior of the folding shed 100 as shown in FIG. 11 until the exterior surfaces for the left and right sections 120, 122, 124, 126 for each front and rear end walls 110, 112 approximately abut each other as shown in FIG. 12. Upon completion of this step, the folding shed 100 is now in a storage or transport configuration. As shown in FIG. 13, in such a configuration the exterior surfaces of the left and right sections 120, 122, 124, 126 of the front and rear end walls 110, 112 approximately abut each other and the interior surfaces of the left and right sections 120, 122, 124, 126 of the front and rear end walls 110, 112 approximately abut the interior surfaces of the left and right sidewalls 106, 108, respectively.

As described above, any or all of the roof, end wall, and sidewall panels 144, 156, 134*a-b* may include openings in order to remove some or all of the roof, end wall, and sidewall filler from any or all of the roof, end wall and sidewall panels 144, 156, 134*a-b*, respectively. The removal of some or all of roof, end wall, or sidewall filler prior to transforming the folding shed 100 from an operation to a transport or storage configuration may reduce the weight of the folding shed 100, thereby potentially reducing the effort required to transform the folding shed 100 to its storage or transport configuration. Such a situation may especially arise when the material used for the filler (e.g., sand) is selected to increase the weight of the folding shed 100 to resist wind and other overturning or uplift forces.

To transform the folding shed 100 from the storage or transport configuration shown in FIG. 13 to an operation configuration as shown in FIG. 1 or 2, the steps described above for transforming the folding shed 100 from an operation to a storage or transport configuration may be repeated in reverse order. Also, although the steps for transforming a shed 100 from an operation to a storage or transport configuration, or vice versa, are described in a certain order, the steps may be performed in a different order or some steps may be omitted. For example, rather than outwardly pivoting the left roof section 114 first, the right roof section 116 may be outwardly pivoted first for some folding sheds 100. Further, it should be appreciated that the end wall and sidewall hinges 128, 170, 172 may be configured to permit the left and right sections 120, 122, 124, 126 for either or both end walls 110, 112 to pivot outwardly rather than inwardly. When so configured, the interior surfaces of the left and right sidewalls 106, 108 will approximately abut when the folding shed 100 is configured into its storage or operation configuration.

In one embodiment, the folding shed 100 in its operation configuration may be approximately 12' wide by 12' long with a height of 6½' at the eaves and 8' at the peak. At this size or smaller, the folding shed 100 can be readily configured from its folded configuration to its unfolded configuration, or vice versa, by one or two people. For larger sheds, mechanical equipment may be used to help move the folding shed 100 to a desired location on site and/or to change the folding shed 100 from a folded to an unfolded configuration, and vice versa.

Figure 14:
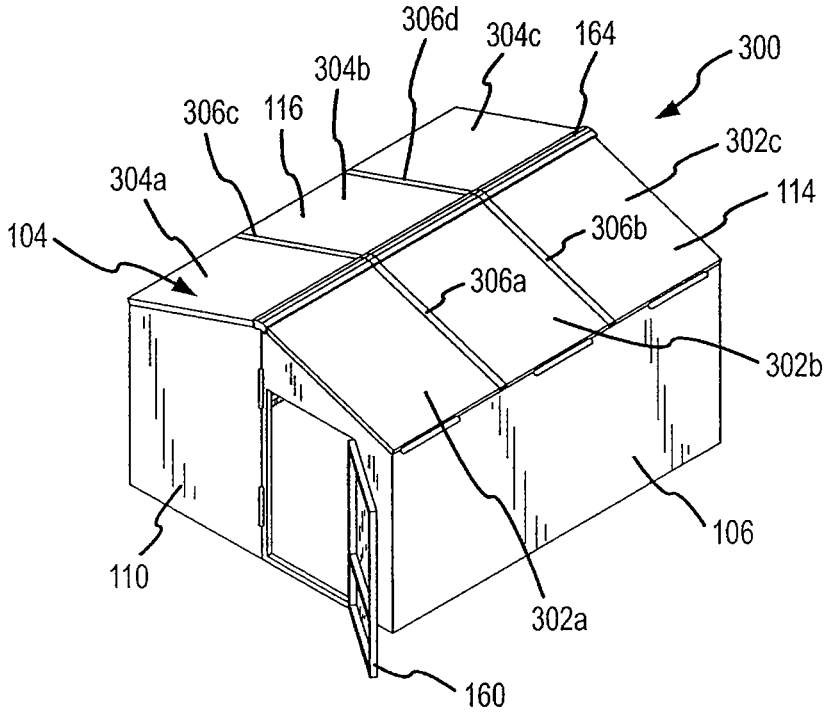
FIG. 14 depicts a front perspective view of a second example of a folding shed.

FIG. 14 depicts a perspective view of a second example of a folding shed 300 where like numbers are used for similar components. The second folding shed 300 is similar to the first folding shed 100 depicted in FIGS. 1 and 2 except the left and right roof sections 114, 116 are separated along vertical lines into one or more roof segments 302*a-c*, 304*a-c*. As shown in FIG. 14, the left and right roof sections 114, 116 are each broken into three roof segments 302*a-c*, 304*a-c* although each roof section 114, 116 could be divided into more or less than three roof segments 302*a-c*, 304*a-c*. The second example of a folding shed 300 as shown in FIG. 14 may also include sloping roof plates 306*a-d* located over the joints formed by the roof segments 302*a-c*, 304*a-c*. These sloping roof plates 306*a-d* help prevent water from entering into the folding shed 300 through the joints formed by adjacent roof segments 302*a-c*, 304*a-c* and may be connected to the roof segment 302*a-c*, 304*a-c* in a manner similar to that described above for connecting the roof plate 164 to the right and left roof sections 114, 116. The framing structure of the roof 104, the sidewalls 106, 108, the end walls 110, 112, and the door 160, is also slightly varied from the system depicted and described in FIGS. 1 and 2. Specifically, the panels for the roof 104, the sidewalls 106, 108, the end walls 110, 112, and the door 160, are connected on the exterior of the horizontal, vertical, and/or sloping roof, sidewall, end wall, and door members rather than between these members as shown in FIGS. 1 and 2. It should be recognized, however, that the frame structure depicted in FIGS. 1 and 2 for the roof 104, the sidewalls 106, 108, and the end walls 110, 112 may also be used in the second example of a folding shed 300. Further, any other construction method used to form walls, roofs, and doors for structures may be used.

Figure 15:
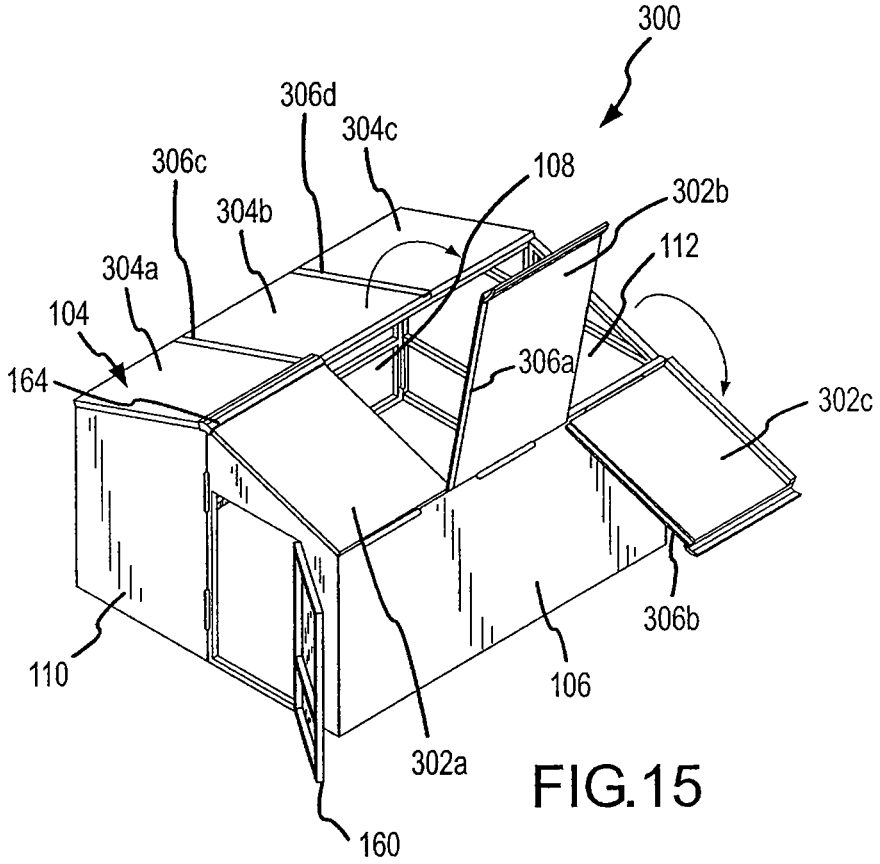
FIG. 15 depicts a front perspective view of the second example of the folding shed depicted in FIG. 14 with two roof segments for the left roof section shown in a partially opened position.

The method for transforming the second folding shed 300 depicted in FIG. 14 from an operation to a storage or transport configuration is similar to that described for the first example of the folding shed 100 depicted in FIGS. 1 and 2. The primary difference is that transforming the left and right roof segments 114, 116 from an operation to a storage or transport configuration (or vice versa) involves pivoting multiple roof segments 302*a-c*, 304*a-c* for each roof section 114, 116 rather than the entire roof section 114, 116. A potential advantage for configuring the roof sections 114, 116 this way is that rather than moving one large roof section, each roof section 114, 116 may be pivoted relative to its respective sidewall 106, 108 in smaller, potentially more manageable segments. The remaining steps for transforming the second folding shed 300 depicted in FIGS. 14 and 15 are substantially the same as those described above with respect to the first folding shed 100 depicted in FIGS. 1 and 2.

Figure 16:
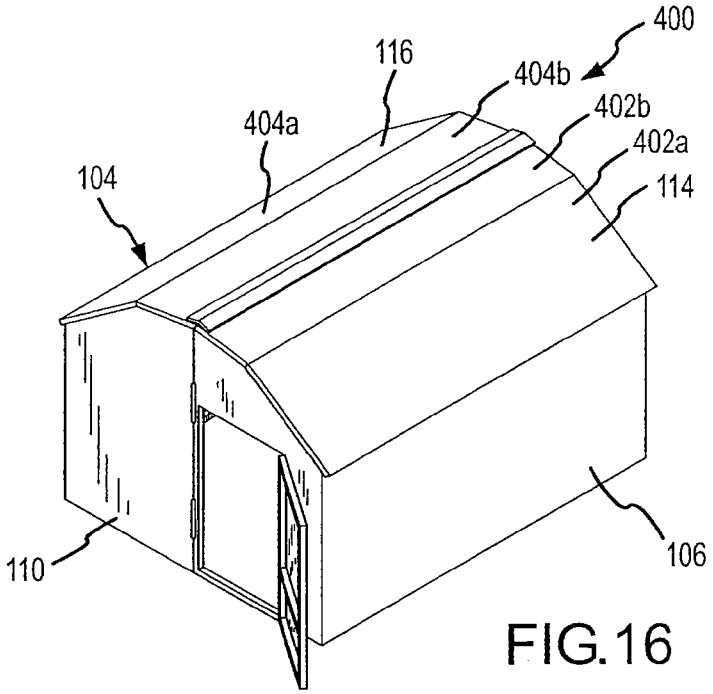
FIG. 16 depicts a front perspective view of a third example of a folding shed.

FIG. 16 depicts a perspective view of a third example of a folding shed 400, where like numbers are used for similar components. The third folding shed 400 is similar to the first folding shed 100 depicted in FIGS. 1 and 2 except the left and right roof sections 114, 116 have been separated into horizontal roof segments 402*a-b*, 404*a-b*. The upper and lower roof segments 402*a-b*, 404*a-b* for each roof section 114, 116 may be connected together by hinges so that each upper roof segment 402*b*, 404*b* may be pivoted relative to its respective lower roof segment 402*a*, 404*a*. Further, the upper roof segments 402*b*, 404*b* for each roof section 114, 116 may have a lesser slope than their respective lower roof segments 402*a*, 404*a*. Although the slopes of upper roof segments 402*b*, 404*b* for each roof section 114, 116 are depicted as being smaller than the slopes of their respective lower roof segments 402*a*, 404*a*, the slopes of the upper roof segments 402*b*, 404*b* for either roof section 114, 116 could be the same as or greater than the slopes of their respective lower roof segment 402*a*, 404*a*. Additionally, although each roof section 114, 116 is depicted as being divided into two horizontal roof segments 402*a-b*, 404*a-b*, each roof section 114, 116 may be divided into more than two horizontal roof segments. Also, the roof may also be divided, if desired, into vertical segments, as shown in FIG. 14.

Figure 17:
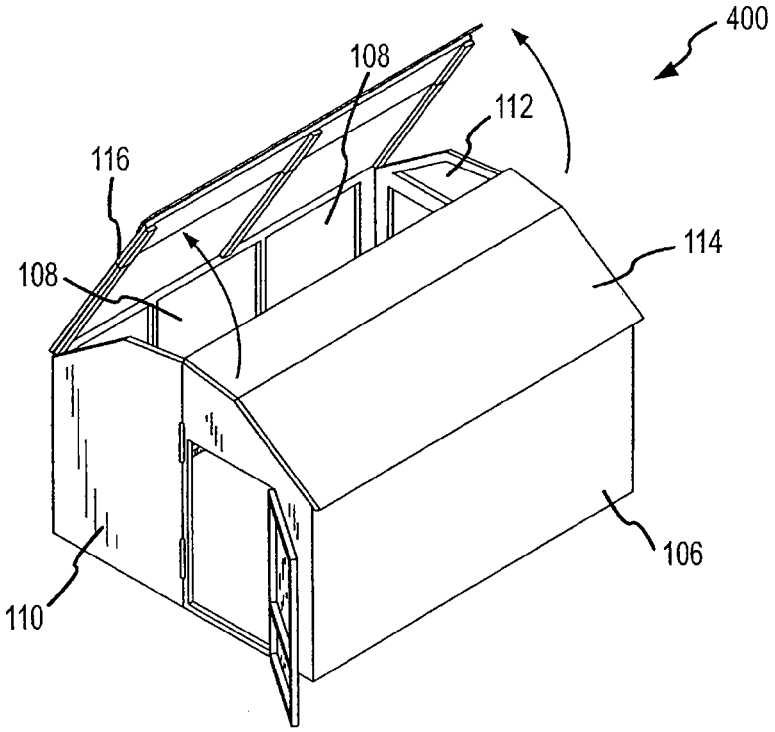
FIG. 17 depicts a front perspective view of a third example of the folding shed depicted in FIG. 16 with the right roof section shown in a partially opened configuration.
Figure 18:
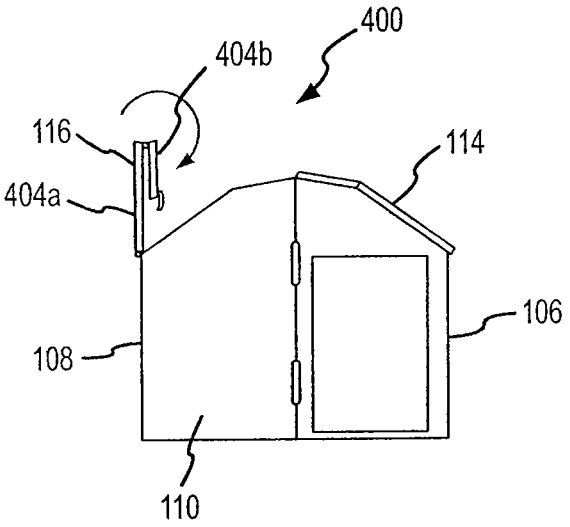
FIG. 18 depicts a front elevation view of a third example of the folding shed depicted in FIG. 16 with the right roof section shown in a partially opened configuration in which the upper and lower roof segments of the right roof section abut each other.
Figure 19:
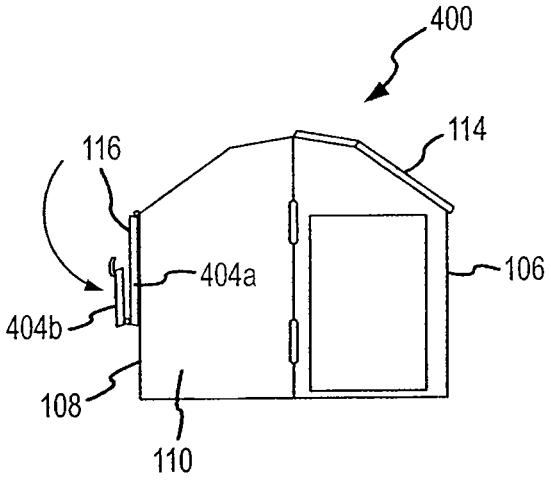
FIG. 19 depicts a front elevation view of the third example of the folding shed depicted in FIG. 16 with the lower roof segments of the right roof section shown abutting the right sidewall.

An operation for configuring the third folding shed 400 from an operation to a storage or transport configuration is similar to that described with respect to the first and second folding sheds 100, 300 except with respect to the movement of the roof sections 114, 116. FIGS. 17 through 19 show one method for transforming the roof sections 114, 116 for the third folding shed 400 from an operation to a storage or transport configuration, or vice versa. As shown in FIG. 17, both the lower and upper roof segments 404*a-b* of the right roof segment 116 may be pivoted outwardly away from the right end wall 108. After pivoting both roof segments 404*a-b* away from the right end wall 108, the upper roof segment

404*b* may be pivoted inwardly towards the lower roof segment 404*a* until the upper roof segment 404*b* abuts the lower roof segment 404*a* as shown in FIG. 18. The lower roof segment 404*a* may then be pivoted outwardly towards the right sidewall 108 until the lower roof segment 404*a* abuts the right sidewall 108 as shown in FIG. 19. The upper and lower roof segments 402*a-b* of the left roof section 114 may be similarly pivoted to cause the left roof section 114 to abut the left sidewall 106 in a manner similar to that shown for the right roof section 116. The method of transforming the third folding shed 400 depicted in FIG. 16 from an operation to a storage or transport configuration (or vice versa) then proceeds in a manner similar to the one described with respect to the first folding shed 100 depicted in FIGS. 1 and 2.

Although the upper roof segment 404*b* is depicted and described as being pivoted inwardly towards the lower roof segment 404*a*, the upper roof segments 402*b*, 404*b* for either roof section 114, 116 may be configured to pivot outwardly towards its respective lower roof segment 402*a*, 404*a* until it aligns with or abuts is respective lower roof segment 402*a*, 404*a*. Each lower roof segment 402*a*, 404*a* would then be pivoted outwardly towards its respective sidewall 106, 108 until the upper roof segments 402*b*, 404*b* approximately abut their respective sidewalls 106, 108.

Figure 20:
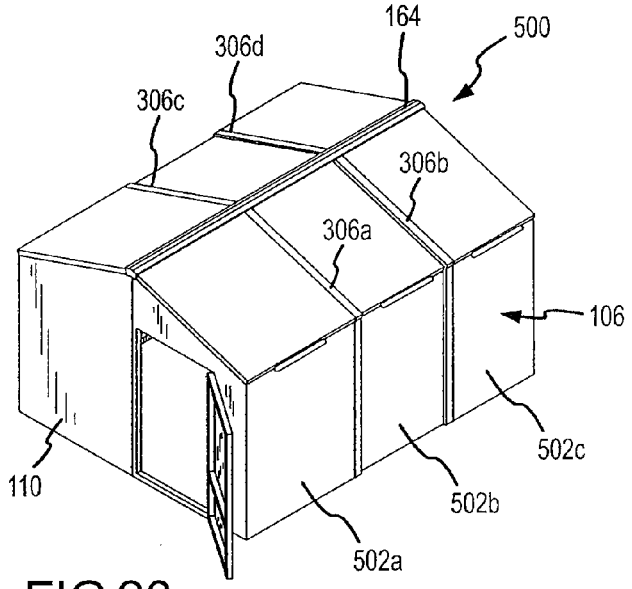
FIG. 20 depicts a front perspective view of a fourth example of a folding shed.

FIG. 20 depicts a perspective view of a fourth example of a folding shed 500 where like numbers are used for similar components. The fourth folding shed 500 is similar to the second example of the folding shed 300 depicted in FIG. 14 except the left and right sidewalls 106, 108 have also been divided into vertical segments 502*a-c*, 504*a-b*. By dividing the left and right sidewalls 106, 108 into multiple segments 502*a-c*, 504*a-b*, the fourth example of a folding shed 500 now includes four separate structural components. The first structural component includes the front end wall 110 and a portion of the left and right sidewalls 106, 108 and roof sections 114, 116. The second and third structural components include a portion of either the left and right sidewalls 106, 108 and their respective roof sections 114, 116. The fourth structural component includes the rear end wall 112 with a portion of the right and left sidewalls 106, 108 and roof sections 114, 116. Although depicted in FIG. 20 as having only two structural components composed of only a portion of the sidewalls 106, 108 and the roof sections 114, 116, the folding shed 500 may have more than two structural components that include partial roof and sidewall sections 106, 108, 114, 116. For example, the fourth example of the folding shed 500 could have two partial right sidewall and roof sections 108, 116 and two partial left sidewall and roof sections 106, 114 for a total of four structural components with partial sidewalls and roof sections 106, 108, 114, 116.

The fourth example of a folding shed 500 as shown in FIG. 20 may further include vertical sidewall plates 506*a-c* located over the joints formed by the sidewall segments 502*a-c*, 504*a-b*. These vertical sidewall plates 506*a-c* help prevent water from entering into the folding shed 500 through the joints formed by adjacent sidewall segments 502*a-c*, 504*a-b* and may be connected to their respective sidewall segments 502*a-c*, 504*a-b* in a manner similar to that described above for connecting the roof plate 104 to the right and left roof sections 114, 116.

Figure 21:
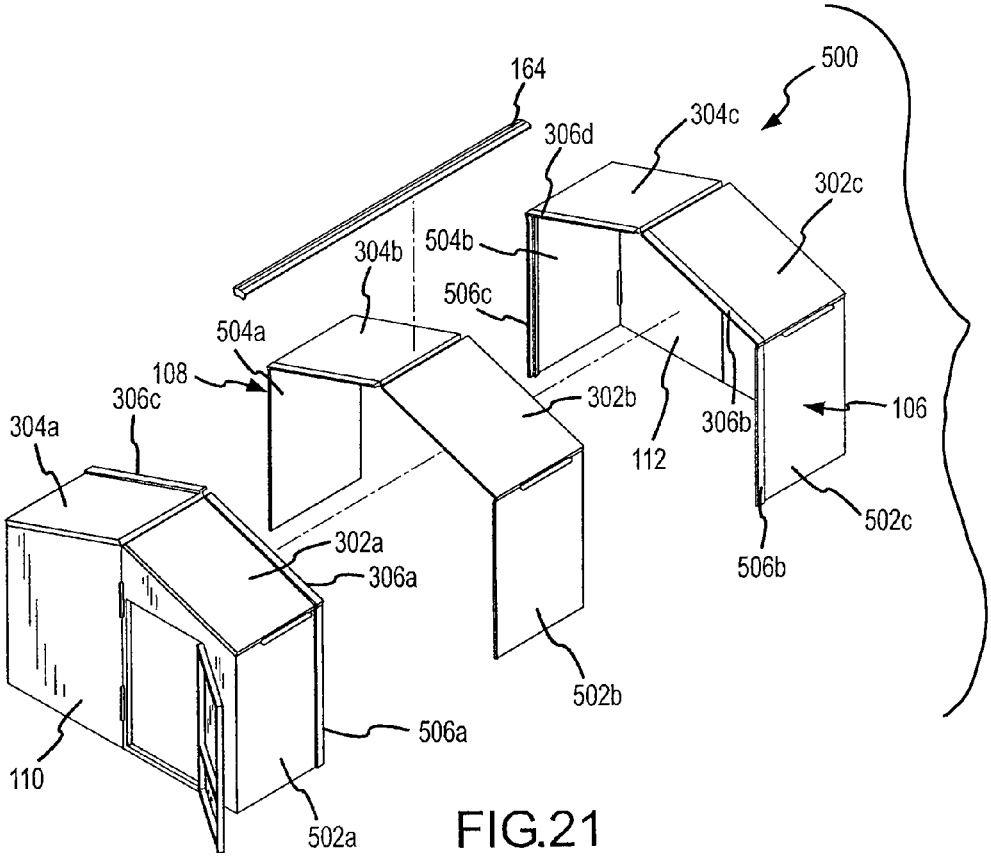
FIG. 21 depicts an exploded front perspective view of the fourth example of a folding shed depicted in FIG. 20.

A method for transforming the fourth example of a folding shed 500 from an operation to a transport or storage configuration may be similar to the one described above for the first folding 100 shed except the four structural components may be disconnected from each other prior to pivoting the roof sections 114, 116 and the end walls 110, 112. More particularly, as shown in FIG. 21, the roof plate 104 may be first removed from the folding shed 500 and each structural component may be disconnected from its adjacent structural component. After disconnecting each structural component, the various roof segments 302*a-c*, 304*a-c* may be pivoted relative to their supporting sidewalls segments 502*a-c*, 504*a-b* and the various end wall sections for each end wall 110, 112 pivoted relative to each other as described in more detail above with respect to the first folding shed 100. It should be appreciated, however, that any or all of the structural components may be disconnected from adjacent structural components after performing any or all of the pivoting steps when transforming the shed 500, or that any or all the structural components may not be disconnected from adjacent structural components at any time during transformation of the folding shed 500.

Although the sidewalls, end walls, roofs, and doors for various representative examples of folding sheds have been depicted and described as having certain frame or panel structures, the sidewalls, end walls, roofs, and doors for any of the various examples of folding sheds illustrated in the figures or described above may be created using any wall, roof, or door construction method used to create a structure. Furthermore, although various representative examples of this invention have been described above with a certain degree of particularity, those skilled in the art could make numerous alterations to the disclosed examples without departing from the spirit or scope of the inventive subject matter set forth in the specification and claims.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A folding shed comprising:

a first sidewall and a second sidewall;

a first roof section pivotally coupled with the first sidewall by a first roof hinge defining a first hinge axis positioned exteriorly of the folding shed a first distance from the first sidewall and positioned a third distance from the first roof section, wherein the first distance and the third distance are different;

a second roof section pivotally coupled with the second sidewall by a second roof hinge defining a second hinge axis positioned exteriorly of the folding shed a second distance from the second sidewall and positioned a fourth distance from the second roof section, wherein the second distance and the fourth distance are different, wherein the second roof section is pivotable relative to the second sidewall independently of the first roof section;

a foldable first end wall pivotally coupled with the first sidewall and the second sidewall; and a foldable second end wall pivotally coupled with the first sidewall and the second sidewall, wherein the first and second distance is sufficient to provide clearance for the first and second sidewalls, the first and second roof sections, and the first and second foldable end walls to be configurable into a folded position, in which the first and second sidewalls and the first and second end walls are positioned between the first and second roof sections, wherein the first and second distance is sufficient to provide clearance for the first and second roof sections to be configurable to pivot around the first hinge axis and the second hinge axis, respectively, from the folded position, to form a roof above the first and second sidewalls and the first and second foldable end walls forming a first position to define an interior of a shed, and the first roof section pivots outwardly from the center of the shed when the first and second sidewalls, the first and second roof sections, and the first and second foldable end walls are moved between the first position and the folded position.

2. The folding shed of claim 1, wherein the foldable first end wall includes a first section pivotably connected to the first sidewall, and a second section pivotably connected to the first section and to the second sidewall.

3. The folding shed of claim 1, wherein the first end wall is pivotally coupled to the first sidewall with a hinge.

4. The folding shed of claim 3, wherein the first end wall is pivotally coupled to the second sidewall with a hinge.

5. The folding shed of claim 1, wherein a maximum height of the folding shed is less than or equal to approximately eight feet.

6. The folding shed of claim 1, further comprising a roof plate operatively associated with at least one of the first and second roof sections.

7. The folding shed of claim 1, wherein the first roof section includes at least two first roof segments.

8. The folding shed of claim 7, wherein at least one of the at least two first roof segments is pivotable relative to the first sidewall independently of the other first roof segments.

9. The folding shed of claim 7, wherein at least one of the at least two first roof segments is pivotally coupled to an adjacent first roof segment.

10. The folding shed of claim 7, wherein the second roof section includes at least two second roof segments.

11. The folding shed of claim 10, wherein at least one of the at least two second roof segments is pivotable relative to the second sidewall independently of the other second roof segments.

12. The folding shed of claim 10, wherein at least one of the at least two second roof segments is pivotally coupled to an adjacent second roof segment.

13. The folding shed of claim 1, wherein at least one of the first sidewall and the second sidewall includes at least two sidewall segments.

14. The folding shed of claim 1, wherein the first distance is equal to or greater than a thickness of the first roof section.

15. The folding shed of claim 1, wherein the first distance is greater than the third distance.

16. A folding shed comprising:

a first sidewall;

a first roof section pivotally coupled with the first sidewall by a first roof hinge defining a first hinge axis positioned exteriorly of the folding shed a first distance from the first sidewall and positioned a third distance from the first roof section, wherein the first distance and the third distance are different;

a foldable first end wall pivotally coupled with the first sidewall; and a foldable second end wall pivotally coupled with the first sidewall and the second sidewall, wherein the first distance is sufficient to provide clearance for the first sidewall, the first roof section, and the first foldable end wall to be configurable into a folded position, in which the first sidewall and the first end wall are positioned between the first roof section and a second roof section in a folded position, wherein the first distance is sufficient to provide clearance for the first roof section to be configurable to pivot around the first hinge axis from the folded position to form a roof above at least a portion of the first sidewall and the first foldable end wall defining an expanded position, wherein the first roof section also pivots outwardly from the expanded position when the first sidewall and the first foldable end wall are moved between the expanded position and the folded position.

* * * * *